US008402590B1

(12) United States Patent
Larson

(10) Patent No.: US 8,402,590 B1
(45) Date of Patent: Mar. 26, 2013

(54) PUSH BROOM HEAD

(75) Inventor: Timothy J. Larson, Onalaska, WI (US)

(73) Assignee: Carlisle Foodservice Products, Incorporated, Oklahoma City, OK (US)

( * ) Notice: Subject to any disclaimer, the term of this patent is extended or adjusted under 35 U.S.C. 154(b) by 345 days.

(21) Appl. No.: 09/876,498

(22) Filed: Jun. 7, 2001

(51) Int. Cl.
*A46B 15/00* (2006.01)

(52) U.S. Cl. ..... 15/160; 15/DIG. 5; 15/DIG. 6; 15/191.1

(58) Field of Classification Search ..... 15/159.1, 15/160, 191.1, DIG. 5, DIG. 6; D4/132–134
See application file for complete search history.

(56) References Cited

U.S. PATENT DOCUMENTS

| | | | | | |
|---|---|---|---|---|---|
| 608,365 | A | * | 8/1898 | Goehring | 15/160 |
| 2,043,758 | A | | 6/1936 | Lay | 15/159 |
| 2,262,961 | A | * | 11/1941 | Otto | 15/159.1 |
| D186,760 | S | * | 12/1959 | Larson et al. | D4/134 |
| 3,315,296 | A | * | 4/1967 | Richardson | 15/159.1 |
| 3,346,900 | A | * | 10/1967 | Stewart et al. | 15/160 |
| 4,042,995 | A | * | 8/1977 | Varon | 15/142 |
| 4,069,537 | A | * | 1/1978 | Matsuo | 15/228 |
| 4,250,589 | A | | 2/1981 | Alvin | 15/193 |
| 4,360,940 | A | * | 11/1982 | Smith | 15/160 |
| 4,385,411 | A | | 5/1983 | Clark | 15/160 |
| 4,422,202 | A | | 12/1983 | Malvasio | 15/106 |
| 4,756,039 | A | | 7/1988 | Pardo | 15/160 |
| 4,853,041 | A | * | 8/1989 | Clardy | 134/6 |
| 5,537,707 | A | | 7/1996 | Middleton | 15/106 |

FOREIGN PATENT DOCUMENTS

EP 0 269 852 * 10/1987

OTHER PUBLICATIONS

English translation to EP 0 269 852, Weihrauch, Oct. 1987.*

* cited by examiner

*Primary Examiner* — Laura C Guidotti
(74) *Attorney, Agent, or Firm* — Dykema Gossett PLLC

(57) ABSTRACT

A push broom head is provided having a substantially rigid base, leading edge, upper and lower surface, central vertical axis, plurality of rows of seats, and a plurality of tufts of bristles. The head includes a leading edge row(s) of tufts of a first type closest the leading edge and a plurality of rows of a second type. The length of the second type of tuft bristles is longer than the length of the first type and the number of rows of tufts of the second type exceeds the first type. The axis of each tuft forms an angle relative to the base's central vertical axis. Preferably, when not in contact with the sweeping surface, the angle of attack of the second type of bristles differs by row and/or the angle of the leading row of tufts exceeds 10 degrees in a forward direction relative to the central vertical axis.

21 Claims, 5 Drawing Sheets

PUSH BROOM HEAD

FIELD OF THE INVENTION

The present invention relates generally to broom heads. More particularly, the present invention relates to an improved push broom head that includes a plurality of rows of two or more types of bristles with different lengths and/or angles of attack.

BACKGROUND OF THE INVENTION

Broom heads of the push type are commonly known. Further, such broom heads are used on many diverse floors and other surfaces for both residential and commercial applications.

Typically, the design of a push broom head is approached with one or more specific applications in mind. Single purpose broom designs have not been preferred, but are often the accepted approach because of the limited success of more versatile broom designs. Design considerations generally take into account the type of debris that is anticipated in use—such as fine or coarse particles of dirt or debris—and the roughness or smoothness of the surface to be swept. In an effort to avoid the need to use more than one broom, each with different types of bristles to remove different types of debris, some conventional broom heads combine bristles of different stiffness into a single broom head.

One intention of a dual-bristle design is to provide an implement that can sweep both fine and coarse particles of debris in one operation. The thought is that as the broom is pushed, a forward row of coarse bristles will loosen and move the heavy particles of dirt while a rear row of less coarse bristles will loosen and move the finer materials that are not picked up by the coarser bristles. Some conventional dual-bristle broom heads consist of a finer-bristled, softer border with a coarser, stiffer center section. However, in many applications, this wastes the effectiveness of a significant number of the bristles, particularly the leading edge of softer/finer bristles.

U.S. Pat. No. 2,043,758 ('758 Lay) discloses a street push broom having a single forward row of coarse bristles and a single rear row of longer, finer bristles. In normal use, the broom head is supported at an angle as the brush head is pushed over a surface. However, while such designs may work on a wider range of particles, they do not necessary operate effectively on a wide range of surfaces, which can range from smooth to quite rough. It also has been found that such angled sweeping action can produce excessive and premature wear on the forward bristles, thereby reducing both the service life and effectiveness of the broom. Moreover, without a varying degree of "preload" (which is generally accomplished by the angle of the trim in conjunction with the angle of the handle of the broom dictated by the angle of the hole in the block), a broom head may not be effective for reaching into many surface irregularities.

Further, conventional dual-bristle-type broom heads (such as the type disclosed in the '758 Lay Patent) often have a limited range of applications that may not provide the desired range or degree of versatility. Commonly, such broom heads are limited to single or narrow bands of forward rows of coarser, non-angled bristles. In some instances, such as when a great deal of debris of various sizes is being swept, the single or narrow bands of coarser rows may fail to catch or move the type of debris that it is intended to collect.

Moreover, conventional push broom heads typically employ level, non-angled bristle fiber trims of at least 2.875 inches, with 3.0 to 3.25 inches being most common. Brooms meant for rougher and/or larger debris generally have longer trim. Garage brooms employ a "standard" trim of 4.0 inches and street brooms, such as that disclosed in the '758 Lay Patent, have the longest trim length—in excess of 4.0 inches, and most typically 5.25 to 6.25 inches. Such conventional broom heads commonly do not employ reduced-diameter bristle fibers. Failure to incorporate reduced-diameter fibers into a broom head design can ignore or overlook several important advantages. Among other things, smaller diameter fibers can typically reach into finer surface irregularities. Further, provided that the relative stiffness of the fibers being compared are similar, more small-diameter fibers can be fit into a given construction area on a broom head, thereby providing a greater number of cleaning tips, which can reinforce one another, and potentially greater cleaning effectiveness for a comparable area of broom head.

As such, there exists a need in the industry for an improved broom head design that, among other things, (i) is suitable for use over a wider range of surfaces and applications; (ii) improves the effectiveness of the sweeping action and incorporates tufts of different types of bristles having reduced diameter fibers and/or different angles of attack; (iii) improves the length of service and effectiveness of the various bristles and helps to prevent premature wear; (iv) reduces the amount of bristle material required; and/or (v) is relatively simple to construct using conventional materials and equipment.

SUMMARY OF THE INVENTION

The present invention recognizes the aforementioned challenges and the limitations associated with conventional push broom heads and is directed to the design of an improved push broom head.

The invention provides a push broom head for sweeping a surface. The broom head is comprised of a substantially rigid base and a plurality of tufts of bristles. The rigid base includes a leading edge, an upper and lower surface, a central vertical axis, and a plurality of rows of seats in the lower surface. The tufts of bristles are connected to the seats of the base and extend downwardly from the lower surface. The tufts of bristles include at least one leading edge row of tufts of a first type of bristle positioned closest to the leading edge of the base. The tufts of bristles also include a plurality of rows of a second type of bristle positioned behind the row (or rows) of tufts of the first type of bristles.

In accordance with a preferred embodiment of the present invention, the length of the second type of bristles is longer than the length of the first type of bristles and the number of rows of tufts of bristles of the second type is greater than the number of rows of tufts the first type of bristles. Also in a preferred embodiment, each tuft of bristles has a central axis that creates an angle of attack relative to the central vertical axis of the base. Moreover, when not in contact with the surface to be swept, the angles of attack of the rows of finer tufts of bristles are different and the angle of attack of the leading row of tufts of bristles preferably exceeds 10 degrees in a forward direction relative to the central vertical axis of the base.

Generally speaking, the angling of bristles and tuft holes relative to the brush block (called tuft flair angle) is for the purpose of changing the size or location of the "cleaning face" of a brush head. By having the bristle tufts angle away from each other as they depart from the brush head or block, they can constitute a larger "cleaning face." A larger cleaning face (as compared to the brush block) allows the brush or broom to effectively clean up against obstacles, such as baseboards or table legs, and/or allows the "cleaning face" to cover gaps in the block, such as the position for the handle attachment.

BRIEF DESCRIPTIONS OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
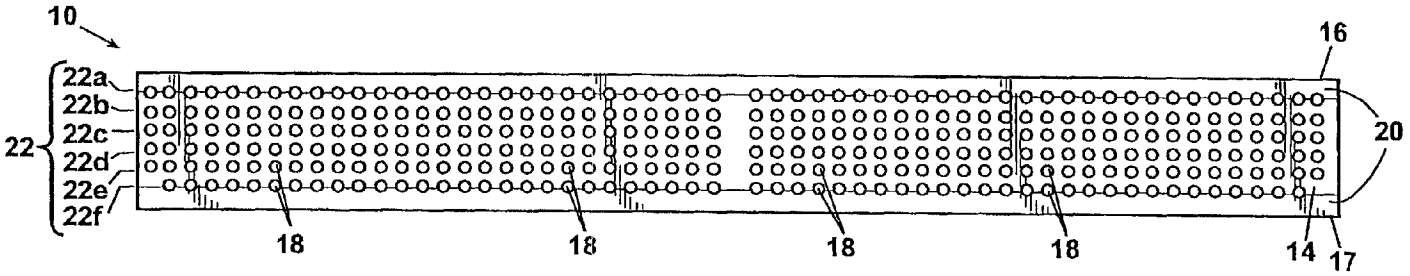
FIG. 1 shows the bottom view of a push broom head base that illustrates the seats without bristle tufts.

Referring now to the drawings, the preferred embodiments of the present invention are described in detail. Turning first to FIG. 1, there is shown a bottom view of a push broom head base 10. Base 10 includes an upper surface 12 (not visible in this figure), a lower surface 14, a leading edge 16, a trailing edge 17, and a plurality of seats 18.

The base 10 is preferably oblong or rectangular in shape. However, in carrying out the present invention, the shape of the base 10 is not so limited and may be modified in various ways without departing from the present invention. As shown in FIG. 1, but perhaps better illustrated in FIG. 2, the base 10 may, if desired, include one or more chamfered segments or inclined portions 20. When employed, such inclined portions 20 can provide certain advantages—as discussed further herein.

As illustrated, base 10 includes a plurality of attachment points or seats 18. The seats, which are preferably drilled and are generally round or oval, provide locations or positions for the connection or attachment of bristles or tufts of bristles to the broom head 10. The seats 18 can be arranged in a variety of configurations, but are preferably arranged in linear rows 22 that are generally parallel to the leading edge 16 and trailing edge 17 of the base 10. The illustrated embodiment depicts six rows, which generally correspond to rows 22*a* through 22*f* of FIG. 1. The rows generally include an equal number of seats 18. However, it is to be noted that the present invention may include any number of rows 22 of seats 18, which may be arranged in a multitude of configurations or patterns. For example, the seats 18 may be arranged in alternating shifted or staggered rows 22. Such offset or staggered rows can help prevent debris from passing through a gap between tufts of bristles from one row to the next. However, if desired, the seats may be arranged in a variety of more random patterns or configurations with differing numbers of seats per row.

The base 10 may be comprised of wood, plastic, metal or any other suitable material. In the preferred construction, the base 10 is substantially or completely rigid and will generally retain its shape when in use. Similarly, the present invention is not limited to a particular method of formation and the base 10 can be formed using various processes that are commonly known to those of skill in the art.

Figure 2:
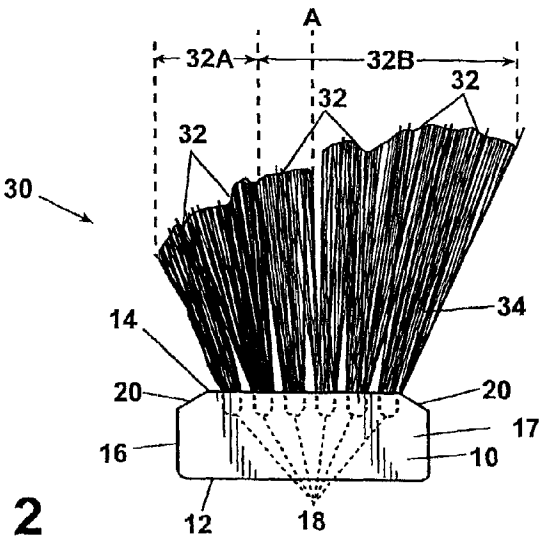
FIG. 2 is a side elevation view of an embodiment of a push broom head constructed in accordance with the present invention.

A side elevation view of an embodiment of a push broom head 30 constructed in accordance with the present invention is illustrated in FIG. 2. The embodiment shown includes a base 10, having a central vertical axis A—which is normal to the central portion of the lower surface 14 of the base—and a plurality of tufts 32 of bristles 34. In accordance with the practice of the present invention, the tufts 32 are attached or secured to or within the seats 18 of the base 10. However, the present invention is not limited to a specific construction technique, and one skilled in the art will appreciate that the tufts 32 may be secured to the seats 18 of the base 10 in any suitable manner.

In accordance with the invention, at least two different types of bristles—and hence, tufts 32 of such different bristles—are included with the push broom head 30. Tufts 32A are made from relatively coarse stiffer bristles or fibers and are designed to remove heavier particles or debris. Although tufts 32A seem coarse and stiff, by having an overall shorter trim, they are actually quite small in diameter when compared to coarse bristles of conventional broom heads. The rear tufts 32B are made from relatively fine bristles or fibers and are adapted to remove finer particles or debris and other materials not fully acted upon by the forward coarser tufts 32A. It should be noted that the term "different" in the context of bristles of different types does not necessarily mean that the bristles are comprised of different materials, although that is an anticipated possibility. For the purposes of the present invention, two bristles may also be "different" if they are structurally different. For example, two "different" bristles may have different lengths and/or diameters, and hence different "stiffness" values.

Generally, the "stiffness" exhibited by a particular type of bristle fiber is the net resultant of the rigidity of the fiber, which is primarily altered by changing its diameter, divided by the unsupported length of the fiber. For example, a relatively coarse fiber, with a first diameter (e.g., 0.022 inches) trimmed to a longer brush length (e.g., 4.0 inches), would generally not appear to be as "stiff" in a sweeping application as smaller diameter (e.g., 0.018 inch) fiber trimmed to a lesser brush length (e.g., 2.5 inches).

The tufts of bristles of the first type (tufts 32A) are positioned in one or more rows closest to the leading edge 16 of the base 10 of the broom head 30. Tufts of bristles of the second type (tufts 32B) are positioned in one or more rows positioned behind the row (or rows) of tufts 32A. In a preferred embodiment of the present invention, tufts 32A will comprise about one-third or less of the total number of tufts (and generally the number of rows of tufts) included in the broom head 30.

The present invention attempts to make use of the foregoing considerations. By decreasing the overall trim length, smaller diameter fibers can be used throughout the entire broom, in both the relatively stiffer or courser and softer or finer bristle sections. Smaller fibers can provide several advantages. For one thing, smaller diameter fibers can reach debris in finer surface irregularities. Also, more fibers of a smaller diameter can be fit on a given construction area of a brush or broom head. In general, if other factors are equal, the greater the number of bristle cleaning tips, the greater the potential cleaning effectiveness of a brush design.

The trim lengths of the bristles 34 of the present invention preferably range from shorter in the front (closest the leading edge 16) to longer in the rear. Moreover, as each row of finer tufts 32B deviates further from the central vertical axis A (taken in the direction from the leading edge 16 toward the trailing edge 17), each subsequent row is preferably slightly longer in length. At the same time, the overall trim length of a broom head 30 constructed in accordance with the present invention is preferably shorter than the bristle trim length used in connection conventional garage and street push brooms. Providing a broom with shorter trim can often better economize bristle material and reduce manufacturing costs. While the present invention is not limited to a single set of precise trim lengths, a preferred embodiment of the present invention has a trim length of bristles ranging from approximately 2.0 inches on the leading side to 2.75 inches on the trailing side. Also, as later discussed in further detail, a significant number of the bristles 34, and tufts of such bristles, are angled.

FIGS. 1 to 4 generally illustrate preferred embodiments of the invention. However, it should be noted that the present invention is not limited to a specific number or combination of rows of tufts 32A and 32B. For instance, if desired for a particular application, the broom head 30 may include additional rows of different types of bristles.

In FIG. 2, tufts 32A are shown positioned in the first two rows closest to the leading edge 16 of the base 10. Tufts 32B are shown positioned in rows positioned behind tufts 32A. If the base 10 depicted in FIG. 2 generally corresponds to the base shown in FIG. 1 (without tufts), then in a preferred embodiment, the first type of tufts of bristles 32A would occupy the seats 18 shown in rows 22*a* and 22*b*. Correspondingly, the second type of tufts of bristles 32B would occupy the seats 18 of rows 22*c* through 22*f*.

Further in accordance with another aspect of the present invention, tufts 32A, 32B are preferably angled relative to the central vertical axis A of the base 10, which is a point of reference generally normal to the central portion of the lower surface 14 of the base 10. When the push broom head 30 is not in contact with a sweeping surface, the first and second tufts 32A and 32B generally at rest at a predetermined angle, wherein the angle of the tufts is primarily created by the tuft rooting system of the seats 18 in the base 10.

Figure 3:
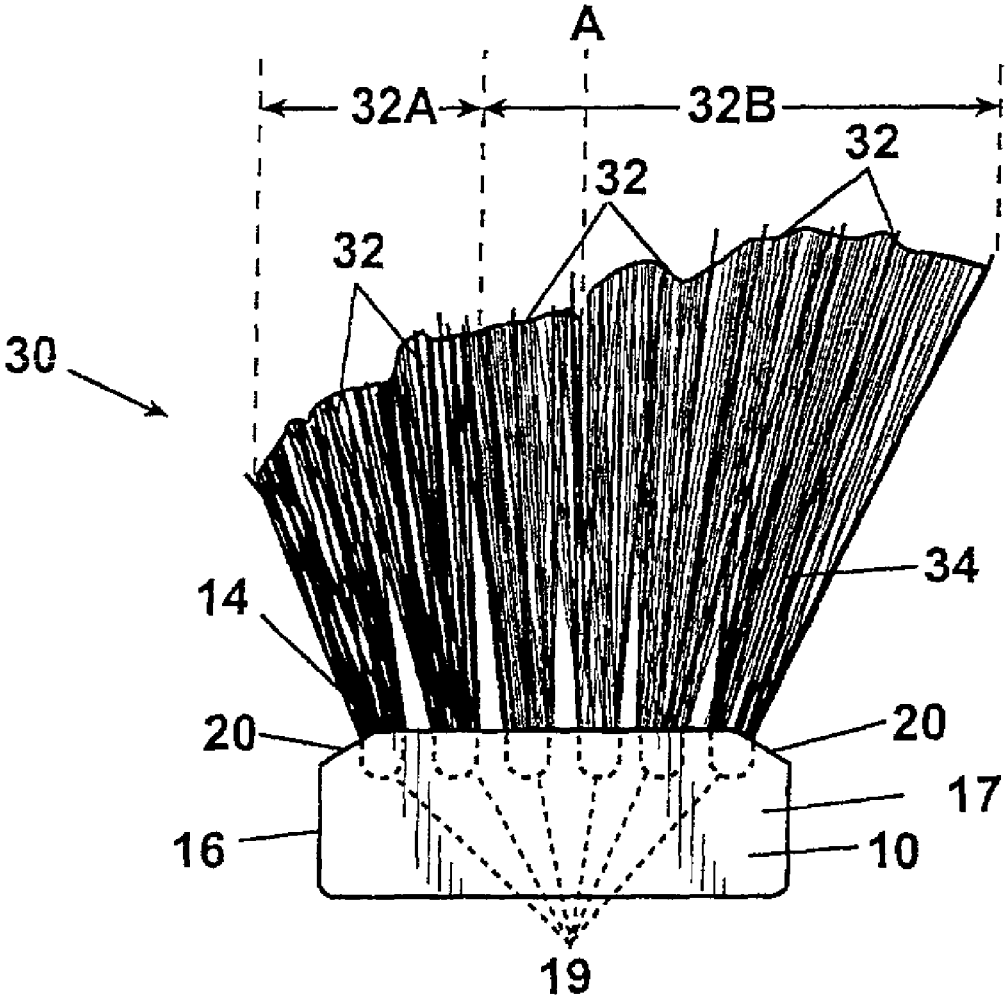
FIG. 3 is a side elevation view of an embodiment of a push broom head constructed in accordance with the present invention.

In accordance with a feature of the teachings of the present invention, chamfered segments or inclined portions 20, if used, may facilitate an increased angle of attack for the rows associated therewith less modification to the internal rooting of the seats 18 relative to the adjacent surface of the base. In a preferred embodiment of the broom head 30, such as illustrated in FIG. 3, all or a portion of one or more rows of forward and/or trailing tufts 32A, 32B (nearest the leading edge 16 and trailing edge 17, respectively) may be rooted in the seats 19 of the inclined portions 20. Typically, a tuft may be attached to a base at an angle of up to about 30-45 degrees relative to the base 10 with little difficult.

In the aforementioned construction illustrated in FIG. 3, the central lines of the first and second rows of tufts 32A are extrapolated (shown by dashed lines) outwardly from their respective bristle ends to form departing angles (or "angles of attack") relative to the central vertical axis A. Geometrically, when the central vertical axis A is perpendicular to the sweeping surface, the contact angles (the angle of the bristle/tuft relative to the ground) will be supplementary to the departing angles.

The angles of attack effect the contact angles and correspondingly control the various amounts of "preload" (or stored energy) in the tufts of bristles that is potentially ready to spring back to their generally straight, non-deformed original state. An important aspect of the present invention is the specific control of the "preload." As discussed further later, a significant feature of an embodiment of the present invention is the ability to purposefully pattern the preload.

For example, an embodiment of the broom head may have a pattern with very little (if any) preload at the front and with progressively more preload toward the rear of the broom head. When the surface is rougher, greater resistance is placed on the bristles and preload is increased, which is commonly desirable for sweeping irregular surfaces.

Figure 4:
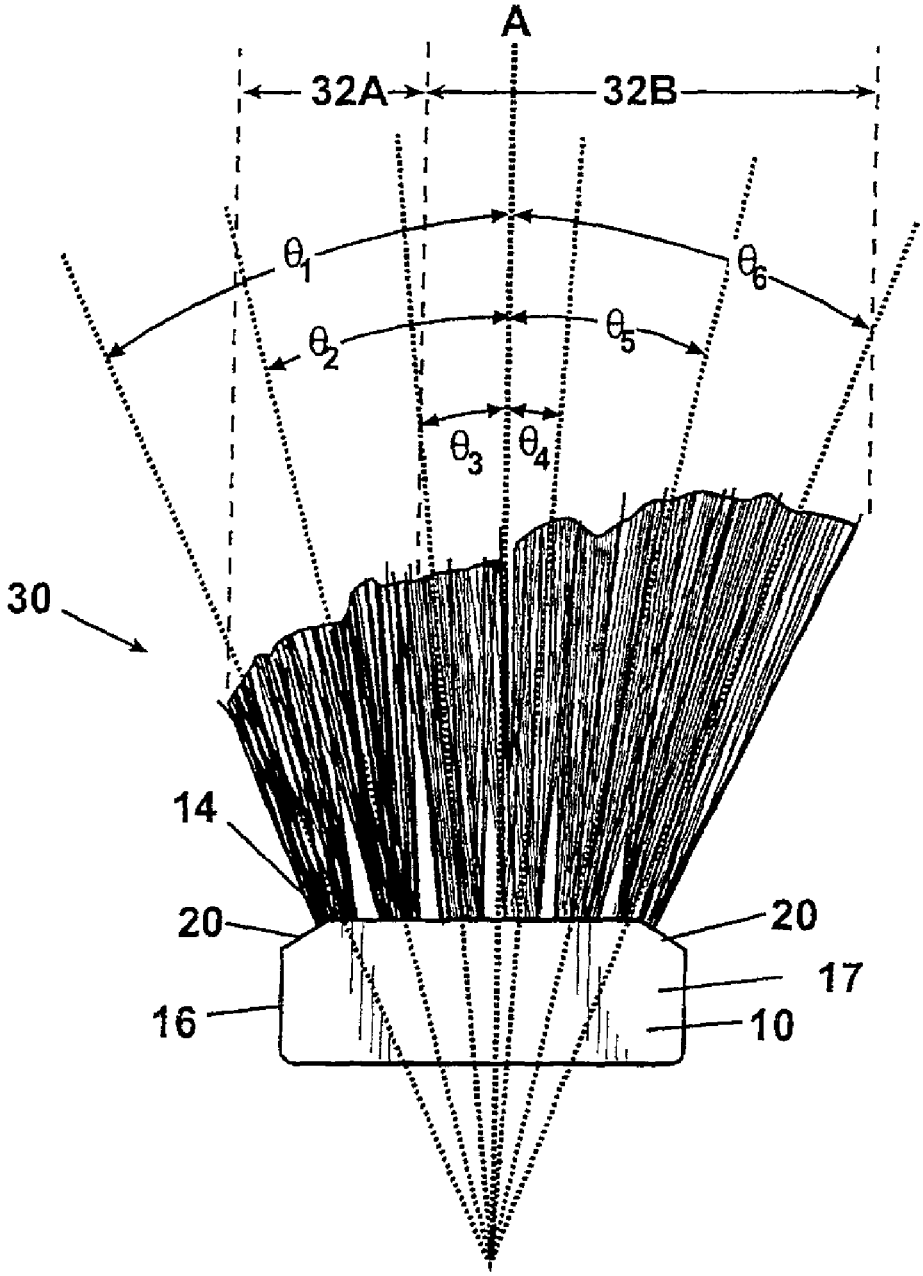
FIG. 4 is a side elevation view of an embodiment of the push broom head similar to that illustrated in FIG. 3.

As shown in FIG. 4, the departing angles, or angles of attack, for the first two rows of tufts 32A from the leading edge 16 are designated as $\theta_1$ and $\theta_2$, respectively. In a similar manner, the angles of attack for the four subsequent rows of finer tufts 32B are consecutively designated as $\theta_3$, $\theta_4$, $\theta_5$, and $\theta_6$, respectively.

In a preferred embodiment of the invention, the angles of attack for the coarser tufts 32A will be positive with respect to the central vertical axis A. The angle of attack for the first row of tufts $\theta_1$ is preferably greater than 10 degrees, is more preferably greater than 15 degrees, and is still more preferably greater than 20 degrees. Furthermore, depending upon the intended application, $\theta_1$ may range from 45 to 60 degrees or more, but generally will be less than 45 degrees for most conventional applications.

Figure 5:
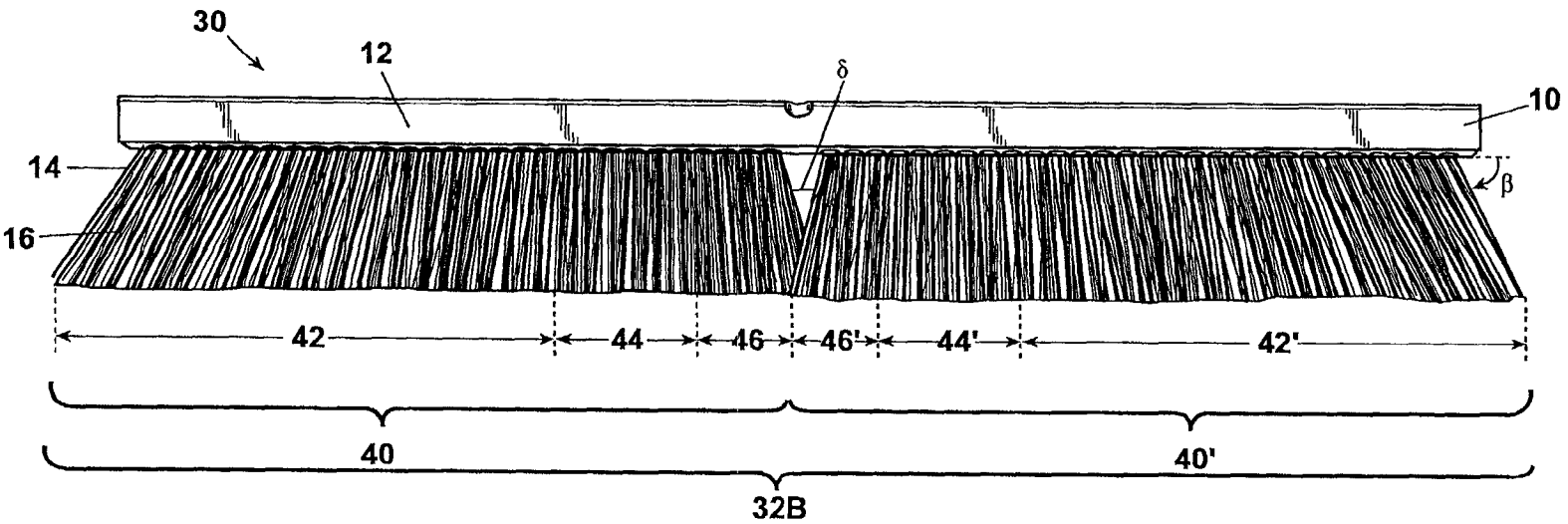
FIG. 5 is a rear elevation view of a push broom head of the type shown in FIG. 3.

Turning to FIG. 5, a rear elevation view of a preferred embodiment of the push broom head 30 is shown. While only the finer tufts 32B are illustrated in this view, the view represents the different angles of the tufts when viewed from another direction. In this particular view, tufts 32B form an angle $\beta$, with respect to central vertical axis A. While not a limitation of the invention, the illustrated embodiment includes two ranges or sections of bristle tufts, generally designated 40 and 40'. The bristles of the tufts of the sections 40 and 40' can each be further broken down into sub-ranges or subsections, designated as 42, 44, and 46, and 42', 44', and 46', respectively.

The bristle tufts of subsections 44 and 44' generally depart the base 10 at an angle $\beta$ of at or near 90 degrees. The departure angle $\beta$ of the bristle tufts of subsections 46 and 46' ranges from 0 to 45 degrees in a first direction from the central vertical axis A. The greater the angle $\beta$ at the outermost tufts (e.g., 42 and 42') from the central vertical axis, the greater the sweeping path of the broom, which can (such as shown), be extended outwardly from the furthest lateral extent of the base 10 of the broom head 30. The departure angle $\beta$ of the bristle tufts of subsections 42 and 42' ranges from 0 to 45 degrees relative to the central vertical axis A in the opposite direction (in the present view) as that of subsections 46 and 46', respectively.

When two or more such "sections" (e.g., 40, 40') are included in a broom head, the tufts of the sections closest to one another will preferably "overlap" to reduce the potential for "gaps" therebetween and provide better bristle coverage for action upon a surface. Portions of sections 40 and 40'—i.e., those shown closest to one another—illustrate an example of overlapping bristles. The angle $\delta$ shown formed between the bristles subsections 46 and 46' of sections 40 and 40', respectively, provides a relative measurement for the amount of bristle overlap between the sections 40 and 40', and more specifically between subsections 46 and 46'. Preferably, the angle $\delta$ should be such that it covers any gap. The greater the angle $\delta$, the greater the amount of overlap of bristles between the subsections to address a gap between the sections. Preferably, the angle $\delta$ will be at least 20 degrees, and more preferably, the angle $\delta$ will be 30 degrees or more.

Figure 6:
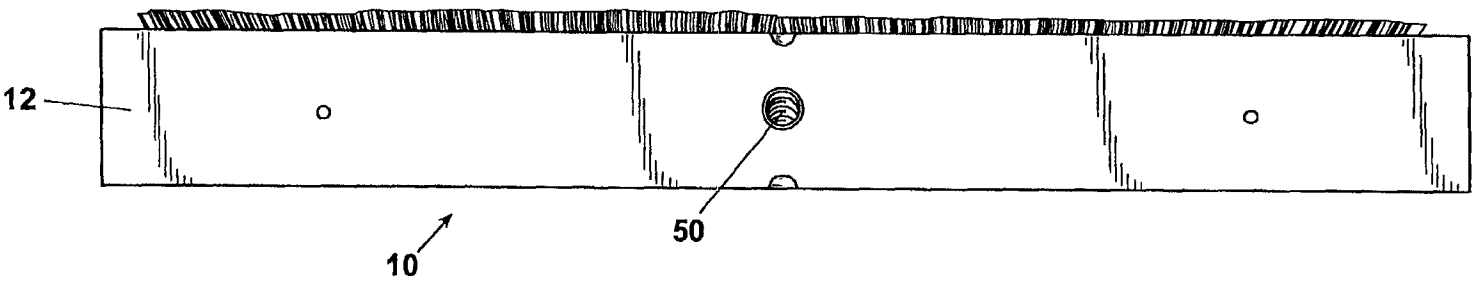
FIG. 6 is a top plan view of a push broom head of the type shown in FIG. 3.

FIG. 6 generally illustrates a top plan view of a push broom head of the type shown in FIG. 4. In the exemplary apparatus, a connection means or opening 50 is provided in the central portion of the upper surface 12 of the base 10 to provide an attachment point or socket for the connection or reception of a corresponding handle (not shown). In a preferred embodiment, the opening 50 is diagonally tapered and is designed to securely receive a corresponding, conventionally formed handle end.

Figure 7:
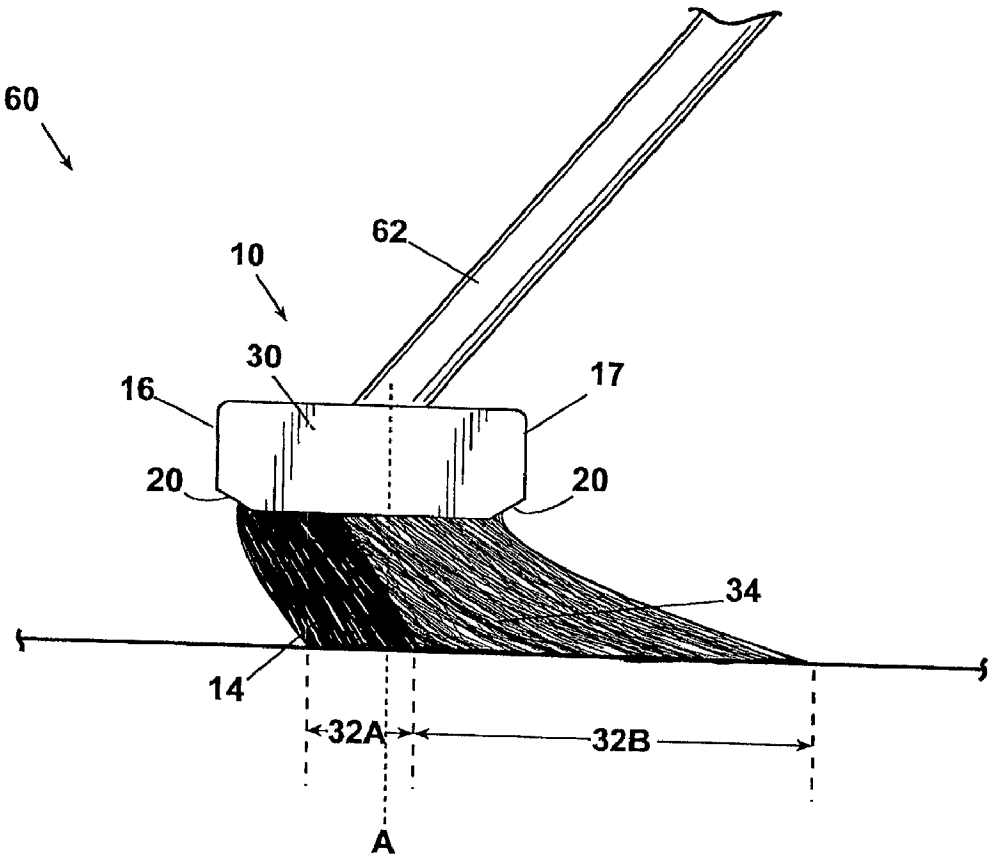
FIG. 7 is a side elevation view showing an embodiment of a broom head of the type disclosed in the present invention in the act of sweeping.

FIG. 7 is a side elevation view showing an embodiment of a broom 60 having a handle 62 and a broom head 30 of the type disclosed in the present invention shown in the act of sweeping. On the initial forward movement of the brush head 30, larger particles of material and refuse will generally be loosened and moved by the coarser tufts 32A. It is intended that finer particles, which may not be acted upon by the coarser tufts 32A, will be acted upon by the finer tufts 32B so that the surface will be generally cleaned of both types of debris in one operation with a single push broom.

A user holding broom handle 62 and applying a forward force to the broom head 30 will cause the bristles 34 of the coarser and finer tufts 32A, 32B to contact the sweeping surface and to bend or flex rearwardly from the leading edge 16 toward the user. As previously noted, in a preferred embodiment of the invention, the angles of attack for the coarser tufts 32A are positive with respect to the central vertical axis A and is preferably greater than 10 degrees in the forward direction. When the bristles of the broom head 30 are bent or flexed rearwardly, they will individually and collectively exert a preload tension on the surface being swept. The preferred configuration of the present invention provides an additional range of "flex," particularly for the forward bristles having a positive angle of attack. The additional range of preload or flex from a positive angle of attack to a rearward angle (in use) can provide and temporarily store additional energy in the bristles to improve the "spring" forward action of the bristles and the sweeping action of the broom with respect the surface debris.

Further, the finer tufts 32B preferably project below the lowermost ends of the tufts of the coarser tufts 32A and/or are inclined away from the leading edge 16 of the broom head 30. Such finer tufts of bristles 32B will also exert a "flex" or tension directed in a more downward direction on the surface being cleaned than the bristles associated with the forward angled coarser tufts 32A.

The present invention includes a certain inherent adaptation to surfaces of various types. For instance, if the surface being swept is smooth, and therefore has less frictional resistance to the sweeping action, the longer, finer tufts 32B will perform the majority of the sweeping work. In such an instance, the shorter, coarser tufts 32A will act to help support the broom head 30 and prevent or reduce the likelihood that the user will apply excessive force to the finer bristles in the finer tufts 32B, which could reduce their effectiveness and cause premature wear. Similarly, in cases where the surface being swept is rougher, and therefore has a greater frictional resistance to the sweeping action, the finer tufts 32B in the rear of the broom head 30 will readily deflect back and more of the cleaning or sweeping force will be directed to the coarser tufts 32A, which will typically work more effectively on such a surface.

In a preferred embodiment of the invention, a plurality of rows of tufts of finer bristles 32B are present. Further the lengths of the bristles and/or the associated angles of attack for each row of finer tufts 32B is preferably varied. Such variance or dual variances, which may be implemented on a row-by-row basis, can provide a customized configuration that permits the broom head 30 to sweep debris from a plurality of different angles with various surface tensions.

As illustrated in the preferred embodiments shown in FIGS. 2-4, the bristle lengths of the tufts of finer bristles 32A can be intentionally increased slightly (as shown) or substantially with each subsequent row—taken in a rearward direction from the leading edge 16. Further, the angles of attack of the bristles of the finer tufts 32A—taken from the central vertical axis A—may also be increased for each such subsequent row, particularly increasing in the trailing rows of finer tufts 32B that are positioned furthest from the leading edge 16. If included, an inclined surface 20 positioned adjacent to the trailing edge 17 can be used in connection with the rooting system in the base 10 to provide finer tufts 32B that extend therefrom and, when in operation, are less vertical and more horizontal to the surface being swept. Such an orientation can provide extra relief to a downward sweeping motion and a greater dragging effect for sweeping particles of debris that pass beyond the more forward tufts of bristles.

Although certain preferred embodiments of the present invention have been described, the invention is not limited to the illustrations described and shown herein, which are deemed to be merely illustrative of the best modes of carrying out the invention. A person of ordinary skill in the art will appreciate that certain modifications and variations will come within the teachings of this invention and that such variations and modifications are within its spirit and the scope as defined by the claims.

What is claimed is:

1. A push broom head for sweeping a surface comprising:

a rigid monolithic base including a leading edge, a trailing edge, an upper and lower surface, a central vertical axis normal to the lower surface of the base, and a plurality of rows of seats in the lower surface; and a plurality of tufts of bristles connected to the seats of the rigid base and extending downwardly from the lower surface of the base, the tufts of bristles including a plurality of rows of tufts of a first type of bristle positioned closest to the leading edge of the base and a plurality of rows of a second type of bristle positioned tufts of said first type of bristle;

wherein the first type of bristle has a given length extending from the base and the second type of bristle has a length extending from the base that is longer than the length of the first type of bristle, the first type of bristles is more rigid and includes a different material composition or thickness than the second type of bristle; the number of rows of tufts of bristles of the second type is greater than the number of rows of tufts of bristles of the first type; and each tuft of bristles has a central axis creating an angle of attack relative to the central vertical axis of the base;

and further wherein, the angle of attack of one or more rows of the second type of bristle relative to the central vertical axis of the base differ; the average length of bristles in each row, from the leading edge to the trailing edge, progressively increases; the difference in trim length of bristles between the leading edge and the trailing edge is about 0.75 inches, and the trim length of the trailing edge bristles does not exceed about 2.75 inches; the trim length of the leading edge bristles is at least about 2 inches; and the ratio of rows of tufts of bristles of the second type to rows of tufts of bristles of the first type is at least 2:1; and further, wherein the tufts of bristles of the first type comprise one-third or less of the total number of tufts of the broom head.

2. A push broom head for sweeping a surface comprising:

a rigid monolithic base including a leading edge, a trailing edge, an upper and lower surface, a central vertical axis normal to the lower surface of the base, and a plurality of rows of seats in the lower surface; and a plurality of tufts of bristles connected to the seats of the rigid base and extending downwardly from the lower surface of the base, the tufts of bristles including a plurality of rows of tufts of a first type of bristle positioned closest to the leading edge of the base and a plurality of rows of a second type of bristle positioned behind the row of tufts of said first type of bristle;

wherein the first type of bristle has a given length extending from the base and the second type of bristle has a length extending from the base that is longer than the length of the first type of bristle, the first type of bristles is more rigid and includes a different material composition or thickness than the second type of bristle; the number of rows of tufts of bristles of the second type is greater than the number of rows of tufts of bristles of the first type; and each tuft of bristles has a central axis creating an angle of attack relative to the central vertical axis of the base;

and further wherein, the angle of attack of one or more rows of the second type of bristle relative to the central vertical axis of the base differ; the average length of bristles in each row, from the leading edge to the trailing edge, progressively increases; the difference in trim length of bristles between the leading edge and the trailing edge is about 0.75 inches, and the trim length of the trailing edge bristles does not exceed about 2.75 inches; the trim length of the leading edge bristles is at least about 2 inches; and the ratio of rows of tufts of bristles of the second type to rows of tufts of bristles of the first type is at least 2:1; and further wherein each alternating row of tufts, when viewed in the direction from the leading edge to the trailing edge, are staggered with respect to one another.

3. A broom head as recited in claim 2, wherein the base includes an inclined portion.

4. A broom head as recited in claim 3, wherein the inclined portion includes at least one row of seats connected to tufts of bristles.

5. A broom head as recited in claim 3, wherein the base includes an inclined portion substantially adjacent to the leading edge and an inclined portion substantially adjacent to the trailing edge.

6. A broom head as recited in claim 2, wherein, when not in contact with the surface to be swept, the angle of attack of the leading row of tufts of bristles exceeds 10 degrees in a forward direction relative to the central vertical axis of the base.

7. A broom head as recited in claim 2, wherein the rows of tufts of bristles of the first type and rows of tufts of bristles of the second type include substantially the same number of tufts of bristles.

8. A broom head as recited in claim 2, wherein the linear spacing between seats in each row of the lower surface of the base is substantially equivalent.

9. A broom head as recited in claim 2, wherein the spacing between rows of tufts in the lower surface of the base, taken in the direction from the leading edge to the trailing edge, is substantially equivalent.

10. A broom head as recited in claim 2, wherein the row of tufts includes at least two sections and the tufts of the sections adjacent one another form an angle between the bristles and an overlap.

11. A broom head as recited in claim 10, wherein the angle between the bristles that overlap is at least 20 degrees.

12. A broom head as recited in claim 2, wherein the base includes a connection means for attachment to a handle.

13. A broom head as recited in claim 2, wherein the angles of attack of the rows of the first type of bristles is approximately 0 to 45 degrees in the forward direction from the central vertical axis of the base.

14. A broom head as recited in claim 2, wherein the angles of attack of the rows of the second type of bristles increases with each row of such second type of bristles from those closest to the leading edge to those nearest the trailing edge.

15. A push broom head for sweeping a surface comprising:

a rigid monolithic base including a leading edge, a trailing edge, an upper and lower surface, a central vertical axis normal to the lower surface of the base, and a plurality of rows of seats in the lower surface; and a plurality of tufts of bristles connected to the seats of the rigid base and extending downwardly from the lower surface of the base, the tufts of bristles including a plurality of rows of tufts of a first type of bristle positioned closest to the leading edge of the base and a plurality of rows of a second type of bristle positioned behind the row of tufts of said first type of bristle;

wherein said plurality of tufts of bristles flex from said leading edge toward said trailing edge, when a forward force is applied to said rigid base;

wherein the first type of bristle has a given length extending from the base and the second type of bristle has a length extending from the base that is longer than the length of the first type of bristle, the first type of bristle is more rigid and includes a different material composition or thickness than the second type of bristle; the number of rows of tufts of bristles of the second type is greater than the number of rows of tufts of bristles of the first type; and each tuft of bristles has a central axis creating an angle of attack relative to the central vertical axis of the base; and and further wherein, the angle of attack of the leading row of tufts of bristles exceeds 10 degrees in a forward direction relative to the central vertical axis of the base; the angle of attack of one or more rows of the second type of bristle relative to the central vertical axis of the base differ; the average length of bristles in each row, from the leading edge to the trailing edge, progressively increases; the difference in trim length of bristles between the leading edge and the trailing edge is about 0.75 inches, and the trim length of the trailing edge bristles does not exceed about 2.75 inches; the trim length of the leading edge bristles is at least about 2 inches; and the tufts of bristles of the first type comprise one-third or less of the total number of tufts of the broom head.

16. A broom head as recited in claim 15, wherein the base includes a connection means for attachment to a handle; and each alternating row of tufts, when viewed in the direction from the leading edge to the trailing edge, are staggered with respect to one another.

17. A push broom head for sweeping a surface comprising:

a rigid monolithic base including a leading edge, a trailing edge, an upper and lower surface, a central vertical axis normal to the lower surface of the base, an inclined portion, and a plurality of rows of seats in the lower surface, a portion of such seats being situated on said inclined portion; and a plurality of tufts of bristles connected to the seats of the rigid base and extending downwardly from the lower surface of the base, the tufts of bristles including a plurality of rows of tufts of a first type of bristle positioned closest to the leading edge of the base and a plurality of rows of a second type of bristle positioned behind the row of tufts of said first type of bristle;

wherein said plurality of tufts of bristles flex from said leading edge toward said trailing edge, when a forward force is applied to said rigid base;

wherein the first type of bristle has a given length extending from the base and the second type of bristle has a length extending from the base that is longer than the length of the first type of bristle, the first type of bristle is more rigid and includes a difference material composition or thickness than the second type of bristle; the ratio of rows of tufts of bristles of the second type to rows of tufts of bristles of the first type is at least 2:1; the trim length of the leading edge bristles is about 2 inches and the trim length of the trailing edge bristles does not exceed about 2.75 inches; and each tuft of bristles has a central axis creating an angle of attack relative to the central vertical axis of the base;

and further wherein, the angle of attack of the rows of the second type of bristle relative to the central vertical axis of the base differ and increases row-by-row, taken in the direction from the leading edge to the trailing edge; and the average length of bristles in each row, from the leading edge to the trailing edge, progressively increases.

18. A push broom head for sweeping a surface comprising:

a rigid monolithic base including a leading edge, a trailing edge, an upper and lower surface, a central vertical axis normal to the lower surface of the base, and a plurality of rows of seats in the lower surface; and a plurality of tufts of bristles connected to the seats of the rigid base and extending downwardly from the lower surface of the base, the tufts of bristles including a plurality of rows of tufts of a first type of bristle positioned closest to the leading edge of the base and a plurality of rows of a second type of bristle positioned behind the row of tufts of said first type of bristle;

wherein the first type of bristle has a given length extending from the base and the second type of bristle has a length extending from the base that is longer than the length of the first type of bristle, the first type of bristles is more rigid and includes a different material composition or thickness than the second type of bristle; the number of rows of tufts of bristles of the second type is greater than the number of rows of tufts of bristles of the first type, and length of the second type of bristles varies along each row of tufts of bristles; and each tuft of bristles has a central axis creating an angle of attack relative to the central vertical axis of the base;

and further wherein, the angle of attack of one or more rows of the second type of bristle relative to the central vertical axis of the base differ; the ratio of rows of tufts of bristles of the second type to rows of tufts of bristles of the first type is at least 2:1; the trim length of the leading edge of bristles is about 2 inches, the trim length of the trailing edge of bristles does not exceed about 2.75 inches, and the average length of bristles in each row, from the leading edge to the trailing edge, progressively increases.

19. A push broom head for sweeping a surface comprising:

a rigid monolithic base including a leading edge, a trailing edge, an upper and lower surface, a central vertical axis normal to the lower surface of the base, a connection means for attachment to a handle, an inclined portion substantially adjacent to the leading edge, an inclined portion substantially adjacent to the trailing edge, and a plurality of rows of seats in the lower surface, and at least one at least one of the inclined portions including a row of seats connected to tufts of bristles; and a plurality of tufts of bristles connected to the seats of the rigid base and extending downwardly from the lower surface of the base, the tufts of bristles including a plurality of rows of tufts of a first type of bristle positioned closest to the leading edge of the base and a plurality of rows of a second type of bristle positioned behind the row of tufts of said first type of bristle; and wherein the first type of bristle has a given length extending from the base and the second type of bristle has a length extending from the base that is longer than the length of the first type of bristle, the first type of bristles is more rigid and includes a different material composition or thickness than the second type of bristle; the number of rows of tufts of bristles of the second type is greater than the number of rows of tufts of bristles of the first type; each tuft of bristles has a central axis creating an angle of attack relative to the central vertical axis of the base; and the angles of attack of the rows of the first type of bristles is approximately 0 to 45 degrees in the forward direction from the central vertical axis of the base;

wherein, the angle of attack of one or more rows of the second type of bristle relative to the central vertical axis of the base differ; the average length of bristles in each row, from the leading edge to the trailing edge, progressively increases; the difference in trim length of bristles between the leading edge and the trailing edge is about 0.75 inches, and the trim length of the trailing edge bristles does not exceed about 2.75 inches; the trim length of the leading edge bristles is at least about 2 inches; and the ratio of rows of tufts of bristles of the second type to rows of tufts of bristles of the first type is at least 2:1; and wherein, when not in contact with the surface to be swept, the angle of attack of the leading row of tufts of bristles exceeds 10 degrees in a forward direction relative to the central vertical axis of the base; the tufts of bristles of the first type comprise one-third or less of the total number of tufts of the broom head.

20. A broom head as recited in claim 19, wherein there are 4 rows of tufts of bristles of the second type and two rows of tufts of bristles of the first type.

21. A broom head as recited in claim 19, wherein each alternating row of tufts, when viewed in the direction from the leading edge to the trailing edge, are staggered with respect to one another.

* * * * *